United States Patent [19]

Smith

[11] 4,088,592

[45] May 9, 1978

[54] DURABLE FLAME RETARDANT FINISHES FOR TEXTILE MATERIALS

[75] Inventor: Ray E. Smith, Ann Arbor, Mich.

[73] Assignee: Velsicol Chemical Corporation, Chicago, Ill.

[21] Appl. No.: 660,503

[22] Filed: Feb. 23, 1976

[51] Int. Cl.[2] ..... C09K 3/28

[52] U.S. Cl. ..... 252/8.1; 8/116 P; 427/390 D; 427/341; 427/342

[58] Field of Search ..... 252/8.1, 312; 427/390 D, 341, 342; 8/116 P

[56] References Cited

U.S. PATENT DOCUMENTS

| | | | |
|---|---|---|---|
| 3,004,056 | 10/1961 | Nunn et al. | 252/DIG. 1 |
| 3,310,419 | 3/1967 | Wagner | 427/390 D |
| 3,645,936 | 2/1972 | Gardner | 8/116 P |
| 3,660,582 | 5/1972 | Di Pietro et al. | 252/8.1 |
| 3,784,356 | 1/1974 | Wagner | 427/390 D |
| 3,856,535 | 12/1974 | Ferguson | 252/8.1 |
| 3,888,779 | 6/1975 | Chao | 252/8.1 |
| 3,932,502 | 1/1976 | Nachbor et al. | 252/8.1 |
| 3,936,585 | 2/1976 | Leblanc et al. | 252/8.1 |

*Primary Examiner*—Benjamin R. Padgett
*Assistant Examiner*—Deborah L. Kyle
*Attorney, Agent, or Firm*—Robert M. Phipps; Howard J. Greenwald

[57] ABSTRACT

Novel flame retardant finishes comprising a water soluble quaternary phosphonium salt, a water soluble organic nitrogen containing compound, a phosphate ester of haloalkanols, an emulsifying agent which is capable of passing the following three tests: (1) Solubility (Compatability) Test: said emulsifying agent (20 parts by weight) must be soluble in 80 parts by weight of said phosphate ester at less than or equal to 80° C.; (2) Shelf Life Test: a blend of said emulsifying agent and said phosphate ester prepared as in the Solubility Test must remain in one clear homogeneous phase at 22° C. for at least one hour; (3) Finish Formulation Test: a flame retardant finish within the scope of this invention is prepared and must remain in one homogeneous phase for a minimum of 1 hour at 20° C., and water. These flame retardant finishes are excellent for flame retarding textile materials including polyester/cotton blend fabrics.

48 Claims, No Drawings

DURABLE FLAME RETARDANT FINISHES FOR TEXTILE MATERIALS

BACKGROUND OF THE INVENTION

1. Field of the Invention

This invention pertains to finishes containing agents specifically designed to render the materials treated therewith flame retardant.

2. Description of the Prior Art

Recent years have witnessed a great interest in and a growing demand for flame retardant textiles and fabrics. Due to its substantial portion of the textile market, one such fabric which has engrossed the attention of many is polyester/cotton blends. The market dominance of these blends is due in part to consumers' demand for minimum care products of satisfactory overall performance and wear-life. However, polyester/cotton blend fabrics have persisted in evading researchers in their attempts to successfully impart durable flame retardancy to them without a loss of or significant dimunition in their physical properties. For example, although satisfactory flame retardants are available for 100% cotton fabrics and 100% polyester fabrics, satisfactory flame retardants have not hitherto been available for polyester/cotton blend fabrics. This phenomena is in part due to the fact that "(c)hemical systems which have been developed for flame retardant finishing of 100% cellulosics are not necessarily effective in imparting self-extinguishing behavior to fabrics containing cellulosic and polyester fibers." G. C. Tesoro, "Status and Prospects for Flame Resistant Polyester/Cellulose Blend Fabrics," 39, National Technical Information Service, Springfield, Va, 1973. Also, "(t)here are significant differences in the extent to which organophosphorus systems found to be effective flame retardants for cellulose maintain this effectiveness in the presence of polyester." Ibid., 39. Additionally, "(t)he synergistic contribution of nitrogen to flame retardant effectiveness of phosphorus (which has been documented for 100% cellulose substrates) has not been demonstrated as being significant in the presence of polyester." Ibid., 39.

A news release by the Textile Research Institute, Princeton, New Jersey for release not before Mar. 2, 1975, entitled "TRI Studies on Flame Retardancy of Polyester/Cotton Blends," reports that "one of the major problems with polyester/cotton blends is that the flammability behavior of these blends cannot be directly predicted from the behavior of the components. For example, the study at TRI has revealed that such blends ignite sooner, burn faster, generate heat faster, and thermally decompose faster than might be expected on the basis of the behavior of cotton and of polyester alone. The data indicate that there are important interactions between the cotton and the polyester when these two fibers are burned in combination . . . (F)or example, . . . mixtures of polyester and cotton evolve more volatile hydrocarbons, such as ethylene and acetylene, than are evolved by cotton and by polyester when these fibers are pyrolyzed alone under comparable conditions. This is one of the reasons that the blends are difficult to flame retard." This report concludes that "(a) blend becomes a new chemical species with its own unique flammability properties."

In "Progress in the Development of Flame-Resistant Polyester-Cotton Blends," Proceedings in the 1974 Symposium on Textile Flammability, 116, LeBlanc Research Corporation, 5454 Post Road, East Greenwich, R.I., 1974, W. A. Reeves et al. state that "(s)atisfactory flame retardants are available for cotton fabrics and polyester fabrics but are not available for polyester/cotton blend fabrics". Although "(s)ome flame retardants for cellulosic fibers are equally effective on polyester and vice versa if one is only interested in flame resistance", "(p)roperties such as aesthetics and durability to laundering are often lacking in treated fabrics."

Vladimir Mischutin in an article entitled "A New FR System for Synthetic/Cellulosic Blends," *Textile Chemist and Colorist,* Vol. 7, No. 3, pp. 40/2 (March, 1975) reports that "(s)ince the passage in 1967 of the amendment to the 1953 Flammable Fabrics Art, textile researchers have sought to develop technology to produce flame retardant fabrics. This has resulted in the development of various commercial processes to render 100% cotton fabrics flame retardant. In addition, a FR process involving emulsion containing tris(dibromopropyl)phosphate was developed for 100% polyester fabrics. This technology, together with the use of inherently flame retardant fibers, was sufficient to satisfy the requirements for sleepwear in sizes 0–6X; however, the intent of the law was not limited to the sleepwear worn by children. Additional technology was needed to satisfy growing demand for flame retardant fabrics.

"Initially, it appeared a simple matter to combine the available techniques for cellulosic fabrics and for polyester goods and obtain flame retardant blends, which are by far the biggest volume used for apparel. Those that tried this approach were unpleasantly surprised. Existing technology did not answer the requirement on blends, and new techniques were needed.

"Among brominated flame retardants the material most commonly used is tris(2,3-dibromopropyl)phosphate. This material possesses good heat and hydrolytic stabilities; it is highly insoluble in water; it is colorless and nontoxic. However, tris(dibromopropyl)phosphate is a secondary plasticizer and has a tendency to impact (sic) a tacky hand to the substrates to which it is applied. In addition, due to its lack of reactive groups, it is difficult to attach permanently to both synthetic and cellulosic fibers. In view of this, all efforts to obtain a flame retardant system for polyester/cellulosic fabric which would comply with DOC FF 3-71 were completely unsuccessful."

Similarly, Dr. W. F. Battinger states in "The Application of a Phosphonium Salt Flame Retardant to Polyester-Cotton Blend Fabrics," Book of Papers, 1974 National Technical Conference, (October 9 to the 11, 1974, New Orleans, La.), 467, American Association of Textile Chemists and Colorists, P.O. Box 12215, Research Triangle Park, N.C. 27709, 1974, that "the treatment of polyester/cotton blends presents a difficult problem in flammability protection because of the vast differences in physical properties and burning characteristics between two fibers". In this paper, Dr. Battinger reports the results of his research with combination applications of phosphonium salts, urea and tris(2,3-dibromopropyl)-phosphate in the following words:

"The lowered response of LOI to added phosphorus for a blend fabric compared to 100% cotton is indicative of major differences in flammability protective mechanisms for the two fibers. Since the phosphonium salt studied here is only marginally capable of protecting the blend utilizing phosphorus and nitrogen alone, consideration of phosphorus and bromine in combination is a viable alternative. Tris-2,3-dibromopropyl phosphate was chosen as a bromine source because of its ready availability and known activity in improving 100% polyester fabric flammability characteristics. Since the LOI/%P responses for the 50/50 and 65/35 polyester/cotton blend were similar (with respect to the same add-on levels of tetrakis(hydroxymethyl)phosphonium oxalate), the 65/35 blend is used to illustrate the combination effect. . . . The dibromopropyl phosphate in perchloroethylene was padded onto the fabric, followed by drying and curing 1.5 minutes at 400° F. to simulate Thermosoling. The process wash consisted of one Kenmore wash with detergent. . . . (F)ixation as judged by durability of this wash was quite good. Maximum OI values of 0.24 were obtained at about 10% Br applied. From related studies on 100% cotton for this material showing lesser durability, it can be inferred that most of the bromine containing material is associated with the polyester component of the blend. (Note: This is the converse of what applied for the phosphonium salt previously.)

"The identical fabrics used to generate these curves were then subjected to an aqueus application of tetrakis-hydroxymethyl phosphonium oxalate in the same fashion as the blends were treated previously. Applications were set to provide 2% phosphorus. This value was chosen to theoretically yield an increase of 0.05 OI unit. The consequences of the topical application . . . compared to theoretical calculations show excellent agreement indicating the additivity properties of LOI data. Somewhat surprisingly, however, while LOI values of 0.29 were attained, no samples passes the DOC vertical test.

"The anomaly of materials with LOI's of 25 passing the vertical test when phosphonium compounds along were employed, and LOI's of 29 failing when a supplemental bromine compound is used is reconcilable in part by consideration of the action of the materials as flame retardants and the geometry of the test employed. The phosphonium compound is a 'condensed phase' acting flame retardant; no evidence is available indicating its action in vapor phase chemistry, nor is it a melt-decomposition temperature reducer for polyester. Dibromopropyl phosphate, on the other hand, is known to significantly lower the melt decomposition temperature of polyester fiber. For 100% polyester fabrics, flame retardancy is enhanced by this shrinking and dripping away. In a blend with cellulose, however, this cannot occur because of the support provided by the cotton, thus the geometry of burning comes into play. In the LOI test the sample is burned vertically downward; as polyester melts, it flows from the flame front, thus depleting fuel supply. In the DOC test burning is vertically upward and the reverse effect, fuel enrichment, occurs. The net results of these effects logically seems exactly what was observed in these experiments — high LOI's but failures in DOC testing."

Concern has begun to mount as to whether polyester/cotton blend fabrics will lose their share of the textile market because of present, pending, and contemplated federal and state legislation mandating non-flammability standards for, inter alia, fabrics and textiles. A clear example of this concern can be seen in the following excerpt wherein the authors argue for the lowering of the flammability standard for polyester/-cotton blend fabrics:

"The types of fabric used in largest volume for apparel are polyester/cotton blends. At present there is no fully commercial method of producing polyester/cotton fabric to meet FF 3-71, primarily because of problems with the hand of the treated fabrics. Obviously, if there is any extension of standards requiring self-extinguishing properties beyond the present small end-uses (children's sleepwear), the peculiarities of this blend will have to be considered. . . .

"The importance of a standard that is no more restrictive then is necessary to get the maximum reasonably safety under realistic use situations is particularly important for polyester/cotton blend fabrics. These fabrics comprise the major portion of apparel fabrics. They also are the types of fabrics which are the most difficult to flame retard to meet FF 3-71 and retain acceptable esthetics.

"We have been able to produce cellulosic fabrics, polyester fabrics acetate fabrics, modacrylics, blends of thermoplastic fibers, etc. to meet FF 3-71. Flame retardant polyester/cotton durable press fabrics meeting FF 3-71 have not been produced by a commercially viable process.

"The key technical problem is 'hand' of the treated fabrics. The hand of treated fabrics is objectionally stiff because of the necessity of using inordinately high add-ons of chemicals to pass FF 3-71. The modified test methods we have discussed would allow for much lower add-ons of chemicals to be used which would give a more acceptable hand to the treated fabrics. This would also lower the chemical cost of the finish. . . .

"Many apparel items — such as jackets, girls's dresses, hats, bathrobes, topcoats, etc. — may not be laundered 50 times during their life. Standards for apparel by end-use which require less extensive laundering would also allow for lower chemical add-ons to be used.

"A reasonable test method for polyester/cotton apparel fabrics should be developed as soon as possible so that FF 3-71 will not be adopted when new, more restrictive apparel standards may be required in the future." R. B. LeBlanc and D. A. LeBlanc, "Future Flammability Standards for Apparel: Can They be Reasonable and Practical, Too?", Textile Chemist and Colorist, Vol. 7, No. 5, 56/17 (April, 1975).

It has been discovered that novel flame retardant finishes are capable of rendering textile materials, including polyester/cotton blend fabrics, treated therewith flame retardant, i.e., capable of passing the U.S. Department of Commerce FF 3-71 flammability test. The flame retardant finishes of this invention impart durable flame retardancy as well as ease of care properties to fabrics and textiles treated therewith without significantly detrimentally affecting the hand of the treated fabrics and textiles.

SUMMARY OF THE INVENTION

A flame retardant finish comprising from about 15 percent to about 35 percent of a fire retardant compound of the formula $(RO)_3P{=}O$, wherein each R is independently selected from halogenated aliphatic groups containing from 2 to about 6 carbon atoms and from 1 to about 3 halogen substituents per group, and mixtures thereof; from about 25 percent to about 45 percent of a water soluble quaternary phosphonium salt; from about 0.5 percent to about 10 percent of an emulsifying agent which is capable of passing the following three tests: (1) Solubility (Compatability) Text: said emulsifying agent (20parts by weight) must be completely soluble in 80 parts by weight of the flame retardant compound at not greater than 80° C.; (2) Shelf Life Test: a blend of said emulsifying agent and said flame retardant compound prepared as in the Solubility Test must remain in one clear homogeneous phase at 22° C. for at least 1 hour; (3) Finish Formulation Test: a flame retardant finish within the scope of this invention is prepared and must remain in one homogeneous phase for a minimum of 1 hour at 20° C.; from about 9 percent to about 16 percent of a water soluble organic nitrogen containing compound selected from the group consisting of

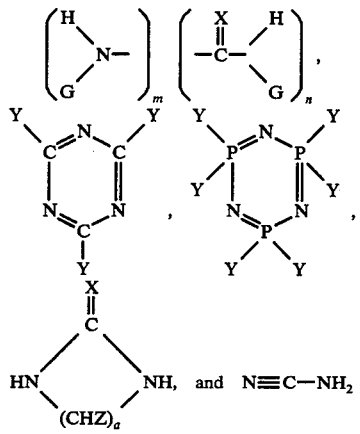

wherein each G is independently selected from the group comprising hydrogen, hydroxymethyl, alkyl containing 1 to 6 carbon atoms, amino, and cyano; X is selected from the group comprising oxygen, sulfur, =NH and =NC≡N; $m$ is an integer from 0 to 1, $n$ is an integer from 1 to 2 with the provision that $m + n$ equals 2; $a$ is an integer from 2 to 3; each Y independently is —NHG wherein G is defined above; and Z is selected from the group comprising hydrogen and hydroxyl; and from about 20 percent to about 32 percent of water.

The flame retardant finish of this invention imparts durable flame retardancy as well as ease of care properties to textiles and fabrics treated therewith. Furthermore, the finish does not require the use of flammable solvents.

DESCRIPTION OF THE PREFERRED EMBODIMENTS

The flame retardant finish of this invention is composed of several constituent parts. One of the constituent parts is a flame retardant compound which comprises from about 15 percent to about 35 percent, preferably from about 20 percent to about 30 percent, and more preferably from about 22 percent to about 27 percent of the flame retardant finish. The flame retardant compound is of the formula $(RO)_3P{=}O$, wherein each R is independently selected from halogenated aliphatic groups containing from 2 to about 6 carbon atoms and from 1 to about 3 halogen substituents per group and mixtures thereof. The flame retardant compound is preferably selected from the group comprising $(XH_2C{-}XHC{-}H_2C{-}O)_3{-}P{=}O$, $(XH_2C{-}HC(CH_2X){-}O)_3{-}P{=}O$ and mixtures thereof wherein X is chlorine or bromine, i.e., tris(dihalopropyl) and tris(dihaloispropyl)phosphates and mixtures thereof. More preferably, the flame retardant compound is $(XH_2C{-}XHC{-}H_2C{-}O)_3{-}P{=}O$ wherein X is chlorine or bromine. Tris(2,3-dibromopropyl)phosphate is the preferred tris-(2,3-dihalopropyl)phosphate flame retardant compound.

A second constituent part of the flame retardant finish of this invention is an emulsifying agent which comprises from about 0.5 percent to about 10 percent, preferably from about 1 percent to about 8 percent, and more preferably from about 2 percent to about 6 percent of the flame retardant finish. The emulsifying agent is capable of passing the following three tests: (1) Solubility (Compatability) Test: said emulsifying agent (20 parts by weight) must be completely soluble in 80 parts by weight of the flame retardant compound at not greater than 80° C.; (2) Shelf Life Test: a blend of said emulsifying agent and the flame retardant compound prepared as in the Solubility Test must remain in one clear homogeneous phase at 22° C. for at least 1 hour, preferably at least 10 hours, and more preferably at least 20 hours; (3) Finish Formulation Test: a flame retardant finish within the scope of this invention is prepared and must remain in one homogeneous phase for a minimum of 1 hour, preferably for a minimum of 2 hours, and more preferably for a minimum of 4 hours at 20° C. The flame retardant compound used in the Solubility (Compatability) Test and the Shelf Life Test is that flame retardant compound or mixture of flame retardant compounds which one desires to employ in the flame retardant textile finish to be formulated. By way of illustration, and not intended to be a limitation on the scope of this invention, phosphated nonionic emulsifiers and phosphated nonionic emulsifiers blended with another emulsifier selected from the group consisting of aliphatic and aromatic nonionic emulsifiers, are two groups of emulsifiers from which emulsifying agents may be selected which are capable of meeting the criteria of the above tests. Said phosphated nonionic emulsifiers and phosphated nonionic emulsifier blends preferably have an acid number of from about 30 to about 130, preferably from about 48 to about 120, and a phosphorus content of from about 2 percent to about 5 percent, preferably from about 2.2 percent to about 4 percent. Exemplary emulsifying agents capable of being employed to this invention include, but are not limited to, a blend of phosphted nonionic and unphosphated nonionic having an acid number of about 49.1 and a phosphorus content of about 2.31 percent and a phosphated nonionic having an acid number of about 118 and a phosphorus content of about 3.9 percent.

A third constituent part of the flame retardant finish of this invention is a water soluble quaternary phosphonium salt which comprises from about 25 percent to about 45 percent, preferably from about 30 percent to about 40 percent, and more preferably about 33.8 percent of the flame retardant finish. The water soluble quaternary phosphonium salt is selected from the group comprising tetrakis(hydroxymethyl)phosphonium and tetrakis(methylhydroxymethyl)phosphonium salts wherein the anion is derived from organic or inorganic, mono or polybasic acids and blends thereof. Examples of inorganic monobasic acids include hydrochloric, hydrofluoric, hydrobromic, hydroiodic, and nitric acids. Examples of inorganic polybasic acids include sulfuric and phosphoric acids. Examples of organic monobasic acids include acetic, propionic, benzoic, methylsulfonic, p-toluenesulfonic, benzenesulfonic, stearic formic, lactic, and picric acids. Examples of organic polybasic acids include oxalic, malic, maleic ethylene diamine hydroxymethyl triacetic, ethylene diamine tetraacetic and tartaric acid. The water soluble quaternary phosphonium salt is preferably a tetrakis(hydroxymethyl)phosphonium salt selected from the group comprising tetrakis(hydroxymethyl)phosphonium phosphate acetate, tetrakis(hydroxymethyl)phosphonium chloride, tetrakis(hydroxymethyl)phosphonium oxalate, and bis(tetrakis(hydroxymethyl)phosphonium sulfate. The more preferred tetrakis(hydroxymethyl)phosphonium salts for use in this invention's flame retardant finish are tetrakis(hydroxymethyl)phosphonium oxalate and tetrakis(hydroxymethyl)phosphonium phosphate acetate, the latter being most preferred.

A fourth constituent part of the flame retardant finish of this invention is a water soluble organic nitrogen containing compound which comprises from about 9 percent to about 16 percent, preferably from about 11 percent to about 14 percent, and more preferably about 12.4 percent of the flame retardant finish. Said nitrogen containing compound is selected from the group consisting of

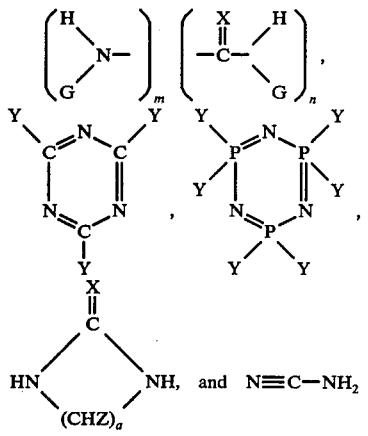

wherein each G is independently selected from the group comprising hydrogen, hydroxymethyl, alkyl containing 1 to 6 carbon atoms, amino, and cyano; X is selected from the group comprising oxygen, sulfur,=NH, and =NC≡N; $m$ is an integer from 0 to 1; $n$ is an integer from 1 to 2 with the provision that $m + n$ equals 2; $a$ is an integer from 2 to 3; each Y independently is —NHG wherein G is defined above; and Z is selected from the group comprising hydrogen and hydroxyl; preferably G is selected from the group comprising hydrogen, hydroxymethyl, amino, and cyano; and all G substituents are preferably the same. Exemplary compounds within the broad class of water soluble organic nitrogen containing compounds that may be used in this invention's flame retardant finish include urea, thiourea, guanidine, dicyandiamide, melamine, trimethylol melamine, aminocyclophosphazene, N-methylocyclophosphazene, ethylene urea, propylene urea, cyanamide and oxamide. Preferred water soluble organic nitrogen containing compounds include urea, thiourea, guanidine, dicyandiamide, melamine, ethylene urea, and propylene urea, with urea being the most preferred compound.

A fifth constituent part of the flame retardant finish of this invention is water which comprises from about 20 percent to about 32 percent, preferably from about 23 percent to about 29 percent, and more preferably about 25.8 percent of the flame retardant finish.

The flame retardant finish of this invention may optionally have incorporated therein a wetting agent. If the wetting agent is a constituent part of the flame retardant finish, the wetting agent would comprise from about 0.1 percent to about 1 percent, preferably from about 0.2 percent to about 0.8 percent, and more preferably about 0.6 percent of the flame retardant finish. The wetting agents which may be employed in this invention may be selected from the group comprising anionic, nonionic, and nonionic-anionic blend wetting agents. Exemplary wetting agents include an anionic phosphate surfactant in free acid form, a nonionic nonylphenyl polyethylene glycol ether, a nonionic octylphenoxy polyethoxy ethanol, a nonionic trimethyl nonyl polyethylene glycol ether, and a nonionic polyethylene glycol ether of linear alcohol. These and other wetting agents are well known to people skilled in the fabric treating art (e.g., McCutcheon's Detergents and Surfactants, Allied Publishing Corp., 1974).

A preferred method of making the flame retardant finish of this invention involves adding the desired amounts of the various constituents in the following sequence:

(1) Mix an aqueous solution of the desired above described water soluble quaternary phosphonium salt with the wetting agent, if used, and with the remaining amount of water to be used, (2) while stirring (1), add an emulsion concentration comprising the above described flame retardant compound and the above described emulsifying agent, and (3) add to the intermediate flame retardant finish of (2) (hereinafter referred to as "intermediate flame retardant finish A") the desired water soluble organic nitrogen containing compound while stirring.

Another preferred method of making the flame retardant of this invention involves adding the desired amounts of the various constituents in the following sequence:

(1) Mix an aqueous solution of the desired above described water soluble quaternary phosphonium salt with the wetting agent, if used, (2) while stirring (1), add an emulsion concentrate comprising the above described flame retardant compound and the above described emulsifying agent, (3) while stirring add to the intermediate flame retardant finish of (2) (hereinafter referred to as "intermediate flame retardant finish B") the remaining amount of water to be used, and (4) add to (3) the desired water soluble organic nitrogen containing compound while stirring.

The above intermediate flame retardant finish A can contain from about 20 percent to about 35 percent, preferably from about 22 percent to about 32 percent, and more preferably from about 25 percent to about 29 percent of the above described flame retardant compound; from about 0.5 percent to about 11 percent, preferably from about 1.5 percent to about 8.5 percent, and more preferably from about 3 percent to about 7 percent, of the above described emulsion; from about 34 percent to about 43 percent, preferably from about 36 percent to about 41 percent, and more preferably about 38.6 percent, of the above described water soluble quaternary phosphonium salt; and from about 26 percent to about 33 percent, preferably from about 27 percent to about 31 percent, and more preferably about 29.4 percent water.

The above intermediate flame retardant finish B can contain from about 22 percent to about 38 percent, preferably from about 24 percent to about 35 percent, and more preferably from about 28 percent to about 32 percent of the above described flame retardant compound; from about 0.5 percent to about 12 percent, preferably from about 1.5 percent to about 10 percent, and more preferably from about 3.5 percent to about 7 percent of the above described emulsion; from about 38 percent to about 47 percent, preferably from about 40 percent to about 45 percent, and more preferably about 42.3 percent, of the above described water soluble quaternary phosphonium salt; and from about 20 percent to about 25 percent preferably from about 21 percent to about 24 percent, and more preferably about 22.7 percent water.

By combining the ranges of intermediate flame retardant finishes A and B, it can be said that the intermediate flame retardant composition of this invention may contain from about 20 percent to about 38 percent, preferably from about 22 percent to about 35 percent, and more preferably from about 25 percent to about 32 percent of the above described flame retardant compound; from about 0.5 percent to about 12 percent, preferably from about 1.5 percent to about 10 percent, and more preferably from about 3 percent to about 7 percent of the above described emulsion; from about 34 percent to 47 percent, preferably from about 38 percent to about 43 percent of the above described water soluble quaternary phosphonium salt; and from about 20 percent to about 33 percent, preferably from about 21 percent to about 31 percent, and more preferably from about 22 percent to about 30 percent water.

Also, each of the above intermediate flame retardant compositions may optionally contain from about 0.2 percent to about 0.8 percent of the above described wetting agent.

The intermediate flame retardant compositions of this invention, i.e., compositions containing the above described water soluble quaternary phosphonium salt, the above described flame retardant, the above described emulsifying agent, and the above described wetting agent, if used, can be used in the ammonia cure process wherein a fabric substrate is treated with said intermediate flame retardant composition and then introduced into an ammonia environment. For a more detailed description of the ammonia cure process see F. H. Day, "The Fire-Stop TM Flame Retardant Process for Cotton Textiles," Proceedings of the 1973 Symposium on Textile Flammability, 41, LeBlanc Research Corporation, 5454 Post Road, East Greenwich, R.I., 1974, and G. Hooper, "Phosphine-Based Fire Retardants for Cellulosic Textiles," Proceedings of the 1973 Symposium on Textile Flammability, 50, LeBlanc Research Corporation, 5454 Post Road, East Greenwich, R.I., 1973, both articles incorporated herein in toto by reference. It should be specifically noted that the ammonia acts in place of the water soluble organic nitrogen containing compound to react with the water soluble quaternary phospnonium salt of the intermediate flame retardant finish to form a highly cross-linked water insoluble phosphorus and nitrogen polymer.

The flame retardant emulsion concentrate, supra, can contain from about 70 percent to about 97 percent, preferably from 75 percent to about 95 percent, and more preferably from about 80 percent to about 90 percent of the above described flame retardant; and from about 3 percent to about 30 percent, preferably about 5 percent to about 25 percent and more preferably from about 10 percent to about 20 percent of the above described emulsifying agent.

Also within the scope of this invention is an emulsion which can comprise from about 8 percent to about 50 percent, preferably from about 15 percent to about 40 percent, and more preferably from about 20 percent to about 30 percent, of the above described flame retardant compound; from about 0.2 percent to about 22 percent, preferably from about 0.8 percent to about 14 percent, and more preferably from about 2 percent to about 8 percent, of the above described emulsifying agent; and from about 28 percent to about 92 percent, preferably from about 46 percent to about 85 percent, and more preferably from about 62 percent to about 78 percent of water.

In addition to being capable of using the above described emulsifying agent in this invention's emulsion or emulsion concentrate, it is also possible to use another emulsifying agent having all the characteristics of the above described emulsifying agent save that the Finish Formulation Test is eliminated and an Emulsion Stability Test substituted therefor. The Emulsion Stability Text entails mixing a blend of 20 parts by weight of said emulsifying agent and 80 parts by weight of the flame retardant compound and converting said blend into a stable aqueous emulsion using the following procedure: (1) heat 500 gms of deionized water to 93° to 100° C; (2) while stirring, slowly add 250 gms of said blend and continue stirring for 15 minutes after final blend addition, maintaining the emulsion temperature at 96° C. for 15 minutes; (3) while stirring, add sufficient cold water to bring the total weight of the emulsion to 1000 gms. The above prepared emulsion must be stable for at least 1 hour, preferably at least 2 hours, and more preferably at least 4 hours.

It should also be noted that the above discussion concerning the preferred flame retardant compounds, the preferred water soluble quaternary phosphonium salt, and the preferred water soluble organic nitrogen containing compounds of the flame retardant finish is equally applicable to the emulsion concentrate, emulsion, and intermediate flame retardant finish, where appropriate.

The flame retardant finish can be applied to textile fabrics by a pad, dry, cure and oxidative afterwash procedure. The temperature of the flame retardant finish during application should be maintained at a temperature of from about 0° to about 28° C. and preferably from about 15° to about 21° C. If necessary, the desired temperature during the padding procedure is maintained by using any suitable heat transfer means such as circulating water through the jacket on the pad box containing the flame retardant finish. When warm rolls of fabric are processed, pass the fabric over cooling means, such as cooling cans, before treating the fabric. The temperature of the finishing bath must be closely controlled or premature polymerization can occur at temperatures above 32° C. Also, inadequate control of the finishing bath temperature might cause non-uniform flame retardancy during long finishing runs.

The textile fabrics should be padded by suitable means such that the wet pick-up is from about 25 percent to about 150 percent and preferably from about 60 percent to about 90 percent of the weight of the untreated fabric. The exact amount of finish applied depends upon the degree of reduced flammability desired. One suitable set of padding conditions includes padding the fabric at from about 6 to 10 tons of pressure using a 1 dip/1 nip or a 2 dip/2 nip fabric lacing and an immersion time of from about 10 to about 12 seconds followed by subjecting the treated fabric to squeezing means to obtain the desired wet pick-up on the treated fabric.

The treated textile fabrics should be dried, preferably frame dried, slightly over the finished width, at from about 100° to about 130° C. and preferably from about 104° to about 110° C.

Curing of the dried fabrics can be done at from about 150° to about 205° C. for from about 90 seconds to about 480 seconds; preferably the curing will be done at about 160° C. for about 300 seconds or at 205° C. for about 120 seconds.

Although fabric drying and curing can take place simultaneously, it is preferred that separate drying and curing operations be performed.

The phosphorus in the treated fabric is oxidized to the +5 valence state by padding the fabric with a solution containing an effective amount of about 5 percent of an oxidizing agent at a temperature of from about 76° to about 83° C. The oxidization treatment and skying time should be such as to insure complete oxidation of the phosphorus in the finish, e.g., from about 30 to about 60 seconds. Both acidic and basic oxidizing agents or conditions may be used. Preferred oxidizing agents include hydrogen peroxide and sodium perborate.

After treatment with the oxidizing solution, the fabric is hot rinsed in water at a temperature of from about 71° to about 83° C. neutralized with a dilute solution of from about 0.1 percent to about 1.0 percent and preferably about 0.5 percent soda ash, said solution having a temperature of about 37° C.; rinsed at about 83° C. and again at 37° C. and dried at about 93° to about 122° C. Optionally, about 0.25 percent of a wetting agent, such as those described above, can be present in the oxidizing solution.

Many textile fabrics can be treated with the flame retardant finish of this invention. Examples of such textile fabrics include cellulosics, rayon, acrylics, polyester, acetates, nylon, and textile fabrics derived from animal fibers, such as wool and mohair, and blends thereof. Typical blends would include 35/65, 50/50 and 65/35 blends of polyester/cotton, 50/50 blend of polyester/rayon and 50/50 blend of acrylic/cotton. Since prior art methods of and means for flame retarding polyester/cotton blend fabrics have proven ineffective, this invention is especially useful for such blends.

The flame retardant finish of this invention, unlike latex base flame retardant systems, does not require the use of a release agent during the fabric processing procedure.

The following examples are provided for the purpose of further illustration only and are not intended to be limitations on the disclosed invention. Unless otherwise specified, all temperatures are expressed in degrees centigrade; all weights are expressed in grams; and all volumes are expressed in milliliters.

EXAMPLE 1

Samples of a 50/50 spun blended polyester and cotton poplin (Style #9503 Testfabric Inc., Middlesex, N.J.) were treated with finishing formulation A, infra, by a pad, dry, cure and oxidative after wash procedure.

Formula A 52.0% Tetrakis(hydroxymethyl)phosphonium phosphate acetate, 65% aqueous solution
7.4% Water
0.2% Wetting agent[1]
12.4% Urea
28.0% Emulsion Concentrate consisting of:

80.0% Tris(2,3-dibromopropyl)phosphate
20.0% Emulsifying Agent[2]

[1]The wetting agent was a nonionic trimethyl nonyl polyethylene glycol ether having an HLB value of 14.1. (Tergitol TMN-6brand wetting agent, Union Carbide Corp., New York, NY)
[2]The emulsifying agent was a blend of phosphated and unphosphated nonionic having an acid number of about 49.1 and a phosphorus content of about 2.31 percent. (AM2-10C brand emulsifying agent, Witco Chemical Co., Inc., Chicago Ill.)

The wet pick-up of the finish was 80.5%. The fabrics were cured for 5 minutes at 160° C. The cured fabrics were oxidized using hydrogen peroxide to insure conversion of all the phosphorus to the +5 valence state. The oxidation was completed in a Kenmore Model 600 washing machine using the following conditions:

(1) Deionized water at 140° C., set at a pH of 10 to 11 with sodium carbonate.
(2) 5% hydrogen peroxide (100%) based on the weight of fabrics (owf).
(3) Add treated fabrics and run regular wash cycle, high water level, rinses at 40° to 44° C.

After oxidation the fabrics were tumble-dried in a Kenmore Model 610 electric dryer.

EXAMPLE 2

Additional pieces of the same fabric used in Example 1 were treated by a pad, dry, cure and oxidative after-wash procedure using the finishing formulation B, infra.

Formula B 52.0% Tetrakis(hydroxymethyl)phosphonium oxalate, 65% aqueous solution
7.4% Water
0.2% Wetting agent[1]
12.4% Urea
28.0% Emulsion Concentrate[2]

[1]The wetting agent was the same as that employed in Example 1.
[2]The emulsion concentrate was the same as that employed in Example 1.

The wet pick-up of finish was 80.2%. The treated fabric samples were dried 5 minutes at 105°0 C. and cured for 5 minutes at 160° C. The samples were oxidized as follows:

(1) Pad 3 times with a solution of 5% hydrogen peroxide (100%) at 80° C.
(2) Rinse in water at 60° C. to remove excess peroxide using a Kenmore Model 600 washing machine set on regular wash cycle, high water level, and rinse water at 40° C.
(3) Repeat above cycle using a 0.05% solution of sodium carbonate at 60° C. in the wash cycle to neutralize any residual acidity, complete rinses at 40° C. and tumble dry.

EXAMPLE 3

Additional portions of the same fabric used in Example 1 were treated according to the processing procedure as described in Example 1 using the finishing formulation C, infra.

Formula C 52.0% Tetrakis(hydroxymethyl)phosphonium phosphate acetate, 65% aqueous solution
35.2% Water 0.4% Wetting agent[1]
12.4% Urea
[1]The wetting agent was the same as that employed in Example 1.

EXAMPLE 4

The flame retardancy of the treated fabrics of Examples 1, 2, and 3 was evaluated using the procedures established by the "Standard for the Flammability of Children's Sleepwear", U.S. Department of Commerce FF 3-71 (DOC FF 3-71). The durability of the flame retardant treatment was determined by measuring the char lengths of the treated fabrics after multiple laundering and drying cycles as set forth in DOC FF 3-71, incorporated herein in toto by reference.

Char length data for the untreated fabric and the treated fabrics of Examples 1, 2, and 3 are shown in the following Table I.

TABLE I

| | Char Length, Inches (DOC FF 3-71) | | | | |
|---|---|---|---|---|---|
| | Laundering and Drying Cycles | | | | |
| | 10 | 20 | 30 | 40 | 50 |
| Untreated | BEL[1] | | | | |
| Example #1 | 2.5 | 2.7 | 3.1 | 4.3 | 5.3 |
| Example #2 | 2.6 | 2.8 | 3.5 | 3.0 | 5.9 |
| Example #3 | BEL | | | | |

[1]BEL - Specimen burned the entire length.

EXAMPLE 5

Samples of an undesized 65/35 polyester and cotton denim were treated by a pad, dry, cure, and oxidative afterwash procedure using the finishing formula D, infra.

Formula D 52.0% Tetrakis(hydroxymethyl)phosphonium phosphate acetate, 65% aqueous solution
7.6% Water
12.4% Urea
28.0% Emulsion Concentrate[1]
[1]The emulsion concentrate of Example 1.

The treated fabric samples were dried 5 minutes at 105° C. and cured 5 minutes at 160° C. The samples were oxidized as follows:

(1) Pad 3 times with a solution of 5% hydrogen peroxide (100%) at 80° C.
(2) Rinse fabric by padding 5 times through water at 80° C. The water is changed after each padding operation.
(3) Neutralize fabric by padding twice through a solution of 0.5% sodium carbonate at 80° C.
(4) Rinse fabric by padding twice through water at 80° C. The water is changed after each padding operation and the samples were dried on pin frames at 105° C.

Char length data for the untreated fabric and treated fabric of Example 5 are shown in Table II, infra.

TABLE II

| | Char Length, Inches (DOC FF 3-71) | |
|---|---|---|
| | Laundering Cycles | |
| Fabric | 0 | 50 |
| Untreated | BEL[1] | BEL |
| Example #5 | 0.8 | 2.2 |

[1]BEL - Specimen burned the entire length.

EXAMPLE 6

Samples of a 50/50 spun blended polyester and cotton twill weighing 9.0 ounces per square yard and dyed black with a combination of disperse and sulfur dyes, were treated by a pad, dry, cure, and oxidative afterwash procedure using the finishing formulation E, infra.

Formula E 50.8% Tetrakis(hydroxymethyl)phosphonium phosphate acetate, 65% aqueous solution
8.2% Water
0.2% Wetting agent[1]
13.4% Urea
27.4% Emulsion Concentrate[2]
[1]The wetting agent used was the same as that employed in Example 1.
[2]The emulsion concentrate was the same as that employed in Example 1.

The wet pick-up finish was 78.5%. The treated fabric samples were dried 5 minutes at 105° C. and cured for 5 minutes at 160° C. The samples were oxidized as follows:

(1) Pad 3 times with a solution of 5% hydrogen peroxide (100%) at 80° C.
(2) Rinse fabric by padding 5 times through water at 80° C. The water is changed after each padding operation.
(3) Neutralize fabric by padding twice through a solution of 0.5% sodium carbonate at 80° C.

Char length data for the untreated fabric and treated fabric of Example 6 are shown in Table III.

TABLE III

| | Char Length, Inches (DOC FF 3-71) | |
|---|---|---|
| | Laundering Cycles | |
| Fabric | 0 | 50 |
| Untreated | BEL[1] | BEL |
| Example #6 | 0.7 | 2.9 |

[1]BEL - Specimen burned the entire length.

EXAMPLE 7

The type of fabric used in Example 1 was treated by a pad, dry, cure, and oxidative afterwash procedure using the finishing formulation F, infra.

Formula F 2595 gms Tetrakis(hydroxymethyl)phosphonium oxalate, 65.0% aqueous solution
20 gms Wetting agent[1]
1398 gms Emulsion Concentrate consisting of:

90% tris(2,3-dibromopropyl)phosphate
10% emulsifying agent[2]

619 gms Urea
[1]The wetting agent was the same as that employed in Example 1.
[2]The emulsifying agent was the same as that employed in Example 1.

The wet pick-up of finish was 75.7 percent. The treated fabrics were dried, cured, and oxidized by the procedure described in Example 5. Char length data for the untreated fabric and treated fabric of Example 7 are shown in Table IV, infra.

TABLE IV

| | Char Length, Inches (DOC FF 3-71) | |
|---|---|---|
| | Laundering Cycles | |
| Fabric | 0 | 30 |
| Untreated | BEL[1] | N.D.[2] |
| Example #7 | N.D. | 5.2 |

[1]BEL - Specimen burned the entire length.
[2]N.D. - Not Determined.

EXAMPLE 8

The type of fabric used in Example 1 was treated by the pad, dry, cure, and oxidative afterwash procedure of Example 5 using the finishing formulation G, infra.

Formula G 1557 gms Tetrakis(hydroxymethyl)phosphonium phosphate acetate, 65.0% aqueous solution
12 gms Wetting agent[1]
839 gms Emulsion Concentrate consisting of:

90% tris(2,3-dibromopropyl)phosphate
10% emulsifying agent[2]

222 gms Water
371 gms Urea

[1]The wetting agent was the same as that employed in Example 1.
[2]The emulsifying agent was a phosphated nonionic having an acid number of about 118 and a phosphorus content of about 3.9 percent. (TL 1003 brand emulsifying agent, ICI America Inc., Wilmington, Del.)

Five panels of said fabric were padded at 60 psi pressure. The wet pick-up was 77.4%. Char length data for the untreated fabric and treated fabric of Example 8 are shown in Table V, infra.

TABLE V

| Fabric | Char Length, Inches Heltra Laundering & Drying Cycles | | |
|---|---|---|---|
| | 0 | 20 | 30 |
| Untreated | BEL[1] | N.D.[2] | N.D. |
| Example #8 | N.D. | 3.0" | 3.8" |

[1]BEL - Specimen burned the entire length.
[2]N.D. - Not Determined

EXAMPLE 9

The following intermediate flame retardant finish, intermediate A, was prepared:

Intermediate A 1243.2 gms Water
4704.0 gms Emulsion Concentrate[1]
8736.0 gms Tetrakis(hydroxymethyl)phosphonium phosphate acetate, 65% aqueous solution
67.2 gms Wetting agent[2]

[1]The emulsion concentrate was the same as that employed in Example 1.
[2]The wetting agent was the same as that employed in Example 1.

Intermediate A is a stable, viscous white emulsion which can be allowed to stand over a period of weeks without detrimentally affecting the performance of the flame retardant finish of this invention.

Each week for a period of 5 weeks a group of samples of the same fabric used in Example 1 was treated by the pad, dry, cure, and oxidative afterwash procedure of Example 5 using the finishing formulation H, infra.

Formula H 2634 gms Intermediate A
372 gms Urea (USP)

The wet pick-up of finish was 90%. The pH of the finish was 5.02. Fabric flammability was measured by the char length procedures of DOC FF 3-71 after multiple launderings cycles in a Heltra Model #1 combination washer and dryer. The treated fabrics were laundered in water at 60° C. containing approximately 0.2% AATCC Standard Detergent #124. The hardness of the water in the washing and rinsing cycles was about 100 ppm ($CaCO_3$) and the fabric to water ratio was about 1:13. The char length data after multiple Heltra laundering cycles are shown in Table VI.

TABLE VI

| Age, Weeks Intermediate A | Char Length, Inches Heltra Laundering & Drying Cycles | | | |
|---|---|---|---|---|
| | 10 | 20 | 30 | 40 |
| 0 | 2.7 | 2.8 | 2.9 | 3.7 |
| 1 | 2.3 | 3.3 | 3.7 | 3.7 |
| 2 | 2.6 | 2.8 | 3.8 | 4.4 |
| 4 | N.D.[1] | N.D. | 3.1 | 3.2 |
| 5 | N.D. | N.D. | 2.8 | 2.3 |

[1]N.D. - Not Determined

As discussed in Example 10, infra, 40 Heltra cycles is comparable to 50 DOC FF 3-71 launderings in soft water.

EXAMPLE 10

Samples of 100% cotton, 100% rayon, 100% polyester, 50/50 polyester/cotton, and 65/35 polyester cotton fabrics were treated with the following finishing formulation I:

Formula I 136.5 lbs. Urea
520.0 lbs. Tetrakis(hydroxymethyl)phosphonium phosphate acetate, 75% aqueous solution
84.0 lbs. Water
2.0 lbs. Wetting agent[1]
280.0 lbs. Emulsion Concentrate[2]

[1]The wetting agent was the same as that employed in Example 1.
[2]The emulsion concentrate was the same as that employed in Example 1.

The finish was applied to the different fabrics in a textile finishing pilot plant equipment with commercially used wet textile finishing equipment by a pad, dry, cure, and oxidative afterwash procedure. The treated fabrics were dried at 116° C. and cured for 3½ minutes at 163° C. on a Fleissner R. T. range equipped with a feed-in-pin tenter.

A double Fleissner perforated drum washer was used to oxidize the cured fabrics. The washer was filled with a 5% solution of hydrogen peroxide (100%) at 77° to 82° C. and the fabrics in the open width were passed through the washer. The fabrics were rinsed in water at 82° C. on the same washer, neutralized with a 0.5% solution of sodium carbonate, rinsed in hot water, followed by a warm water rinse and dried on the Fleissner R. T. range.

Data on wet pick-up of finish, fabric construction, fiber blend level, and char length after multiple launderings cycles is shown in Tables VII and VIII for nine different fabrics.

The durability of the flame retardant treatment was determined by measuring the char lengths of the treated fabrics after multiple launderings (DOC FF 3-71). Char length (DOC FF 3-71) data for the treated fabrics are also presented after multiple launderings in Heltra Model #1, combination washer and dryer. The treated fabrics were laundered in water containing 0.2% AATCC Standard Detergent #124, 100 ppm water hardness ($CaCO_3$) and the fabric to water ratio was approximately 1 to 13. These are the laundering conditions of DOC FF 3-71 using an 8 lb. load with no water hardness specification. Laboratory data indicates that 40 Heltra cycles is equal to 50 DOC FF 3-71 launderings in soft water. The char length data are given in Tables VII and VIII.

All of the untreated fabrics in the unlaundered state with the exception of the 100% spun Dacron 54 polyester fabric, fail the DOC FF 3-71 flammability test.

TABLE VII

Effect of Multiple Launderings on Fabric Flammability

| | Char Length, Inches[a] Heltra Laundering and Drying Cycles (hard water) | | | | |
|---|---|---|---|---|---|
| | 10 | 20 | 30 | 40 | 50 |
| 50/50 Blue C Polyester Cotton Poplin, 5.3 oz/yd², 67% WPU[b] | 4.0 | 2.5 | 5.3 | 5.8 | BEL[c] |
| 50/50 Kodel Polyester/Cotton Herringbone Twill, 7.8 oz/yd², 82% WPU | 1.0 | N.D.[d] | 0.7 | N.D. | 0.6 |
| 50/50 Polyester/Cotton Denim Desized, 8 oz/yd², 79% WPU | N.D. | 0.8 | N.D. | N.D. | 2.5 |
| 35/65 Polyester/Cotton Flannel 5 oz/yd², 125% WPU | N.D. | 1.7 | N.D. | N.D. | 2.8 |
| 100% Spun Viscose Rayon Challis, 4.2 oz/yd², 107% WPU | N.D. | 2.3 | 2.0 | 1.9 | 1.7 |
| 100% Cotton 80 × 80 Print Cloth, 4 oz/yd², 110% WPU | N.D. | 2.4 | N.D. | 2.8 | 2.6 |
| 65/35 Polyester/Cotton Denim-Greige, 8.2 oz/yd² 77% WPU | N.D. | 0.9 | N.D | N.D. | 3.3 |
| 50/50 Polyester/Cotton Twill, 9.1 oz/yd², 82% WPU | 1.3 | 0.8 | N.D. | 0.6 | 2.9 |

[a]Vertical Burn Test Procedure of DOC FF 3-71.
[b]WPU - Wet pick-up
[c]BEL - Specimen burned the entire length.
[d]N.D. - Not Determined.

TABLE VIII

Effect of Multiple Launderings on Fabric Flammability

| | Char Length, Inches[a] Kenmore Laundering Cycles | | | | |
|---|---|---|---|---|---|
| | 10 | 20 | 30 | 40 | 50 |
| 50/50 Blue C Polyester/Cotton Poplin, 5.3 oz/yd², 67% WPU[b] | 3.2 | 3.8 | 3.0 | 3.7 | 3.2 |
| 50/50 Kodel Polyester/Cotton Herring-Bone Twill, 7.8 oz/yd², 82% WPU | 1.2 | N.D.[c] | N.D. | N.D. | 0.7 |
| 100% Spun Dacron 54 Polyester Plain Weave, 5.4 oz/yd², 88% WPU | 2.2 | N.D. | 2.6 | 2.6 | 2.4 |

[a]Vertical Burn Test Procedure of DOC FF 3-71.
[b]WPU - Wet Pick-Up
[c]N.D. - Not Determined The effect of the flame retardant finish on the tensile strength of the treated and untreated fabrics of Table VIII was determined, and these data are shown in Table IX. The flame retardancy of the treated fabrics described in Table IX passed a minimum of 40 to 50 laundering cycles.

The hand of all fabrics treated with a flame retardant finish within the scope of this invention was soft, or, if full, is readily modifiable to a commercially acceptable level by common mechanical treatments, e.g., calendering, sanforizing, etc.

TABLE IX

Physical Test Data for Treated Fabrics

| | WPU, % | Tensile Strength - Pounds | | % Retained | |
|---|---|---|---|---|---|
| | | Warp | Filling | Warp | Filling |
| 50/50 Blue Polyester/Cotton Poplin untreated | — | 93.4 | 49.58 | — | — |

TABLE IX-continued

Physical Test Data for Treated Fabrics

| | WPU, % | Tensile Strength - Pounds | | % Retained | |
|---|---|---|---|---|---|
| | | Warp | Filling | Warp | Filling |
| treated | 67 | 83.9 | 52.72 | 89.8% | 106.4% |
| 50/50 Kodel Polyester Cotton Herringbone Twill untreated | — | 125.9 | 98.9 | — | — |
| treated | 82 | 131.3 | 106.8 | 104.3% | 108% |
| 50/50 Polyester/Cotton Denim Desized untreated | — | 130.3 | 98.3 | — | — |
| treated | 79 | 116.9 | 75.4 | 89.7% | 76.7% |
| 50/50 Polyester/Cotton Twill untreated | — | 163.4 | 97.0 | — | — |
| treated | 67 | 170.5 | 92.3 | 104.3% | 95.2% |
| 100% Spun Viscose Rayon Challis untreated | — | 52.06 | 57.68 | — | — |
| treated | 107 | 43.70 | 36.58 | 83.9% | 63.4% |
| 100% Cotton 80 × 80 Print Cloth untreated | — | 50.92 | 35.88 | — | — |
| treated | 110 | 52.58 | 33.88 | 103.3% | 94.4% |
| 65/35 Polyester/Cotton Denim-Greige untreated | — | 126.0 | 77.8 | — | — |
| treated | 77 | 108.7 | 64.9 | 86.3% | 83.4% |

The above specification as well as the examples contained therein clearly establish that the novel flame retardant finishes of this invention are capable of rendering textile materials, including polyester/cotton blend fabrics, treated therewith flame retardant, i.e., capable of passing the DOC FF 3-71 flammability test, while not significantly detrimentally affecting the hand of the treated fabrics and textiles. In view of the infantile state of the prior art, see G. C. Tesoro, supra, the novel characteristics of polyester/cotton blend fabrics, see Textile Research Institute's press release, supra, the misdirections of the prior art, see V. Mischutin and Dr. W. F. Battinger, supra, and the need for an effective commercial flame retardant capable of meeting the requirements of DOC FF 3-71, see R. B. LeBlanc and D. A. LeBlanc, supra, the present invention must truly be considered a giant step forward in the art of rendering textiles and fabrics flame retardant.

Based on this disclosure, many other modifications and ramifications will naturally suggest themselves to those skilled in the art. These are intended to be comprehended as within the scope of this invention.

The embodiments of the invention in which an exclusive property or privilege is claimed are defined as follows:

1. A flame retardant textile finish, said textile being cotton or a blend of cotton and polyester fibers, consisting essentially of:

(a) from about 15 percent to about 35 percent of a flame retardant compound of the formula $(RO)_3$—P=O wherein each R is independently selected from halogenated aliphatic groups containing from 2 to about 6 carbon atoms and from 1 to about 3 halogen substituents per group and mixtures thereof;

(b) from about 0.5 percent to about 10 percent of an emulsifying agent which is capable of passing the following three tests: (1) Solubility (Compatability) Test; said emulsifying agent (20 parts by weight) must be soluble in 80 parts by weight of said flame retardant compound at no more than 80° C.; (2) Shelf Life Test: a blend of said emulsifying agent and said flame retardant compound prepared as in the Solubility Test must remain in one clear homogeneous phase at 22° C. for at least one hour; (3) Finish Formulation Test: a flame retardant finish within the scope of this invention is prepared and must remain in one homogeneous phase for a minimum of 1 hour at 20° C.;

(c) from about 25 percent to about 45 percent of a water soluble quaternary phosphonium salt selected from the group consisting of a tetrakis(hydroxymethyl) phosphonium and tetrakis(methylhydroxymethyl) phosphonium salts;

(d) from about 9 percent to about 16 percent of a water soluble organic nitrogen containing compound selected from the group consisting of urea, thiourea, guanidine and dicyandiamide; and (e) from about 20 percent to about 32 percent of water.

2. The flame retardant finish of claim 1 comprising:

(a) from about 20 percent to about 30 percent of said flame retardant compound selected from $(XH_2C—XCH—H_2C—O)_3—P{=}O$, $(XH_2C—HC(CH_2X)—O)_3—P{=}O$, and mixtures thereof, wherein X is chlorine or bromine;

(b) from about 1 percent to about 8 percent of said emulsifying agent which is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and the flame retardant compound prepared as in the Solubility Test must remain in one clear homogeneous phase at 22° C. for at least 10 hours; (3) Finish Formulation Test: a flame retardant finish within the scope of this invention is prepared and must remain in one homogeneous phase for a minimum of 2 hours at 20° C.;

(c) from about 30 percent to about 38 percent of said water soluble quaternary phosphonium salt, said quaternary phosphonium salt being a tetrakis(hydroxymethyl) phosphonium salt selected from the group consisting of tetrakis(hydroxymethyl)phosphonium oxalate, tetrakis(hydroxymethyl)phosphonium phosphate acetate, tetraskis(hydroxymethyl)phosphonium chloride, and bis(tetrakis(hydroxymethyl)phosphonium)sulfate;

(d) from about 11 percent to about 14 percent of said water soluble organic nitrogen containing compounds; and (e) from about 20 percent to about 31 percent of water.

3. The flame retardant finish of claim 2 wherein said flame retardant compound is $(XH_2C—XHC—H_2C—O)_3—P{=}O$ and wherein said emulsifying agent is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and the flame retardant compound prepared as in the Solubility Test must remain in one clear homogeneous phase at 22° C. for at least 20 hours; (3) Finish Formulation Test: a flame retardant finish within the scope of this invention is prepared and must remain in one homogeneous phase for a minimum of four hours at 20° C.

4. The flame retardant finish of claim 3 wherein said flame retardant is tris(2,3-dibromopropyl)phosphate and wherein said emulsifying agent is selected from the group consisting of phosphated nonionic emulsifiers and phosphated nonionic emulsifiers blended with another emulsifier selected from the group consisting of aliphatic and aromatic nonionic emulsifiers, said emulsifying agent having an acid number of about 30 to about 130 and a phosphorus content of about 2 percent to about 5 percent.

5. The flame retardant finish of claim 3 wherein said water soluble organic nitrogen containing compound is urea.

6. The flame retardant finish of claim 3 wherein said tetrakis(hydroxymethyl)phosphonium salt is selected from the group consisting of tetrakis(hydroxymethyl)-phosphonium oxalate and tetrakis(hydroxymethyl)-phosphonium phosphate acetate.

7. The flame retardant finish of claim 3 wherein said tetrakis(hydroxymethyl)phosphonium salt is selected from the group consisting of tetrakis(hydroxymethyl)-phosphonium oxalate and tetrakis(hydroxymethyl) phosphonium phosphate acetate.

8. The flame retardant finish of claim 7 wherein said flame retardant compound is tris(2,3-dibromopropyl)-phosphate, wherein said water soluble organic nitrogen containing compound is urea, wherein said tetrakis(hydroxymethyl)phosphonium salt is tetrakis(hydroxymethyl)phosphonium phosphate acetate, and wherein said emulsifying agent is selected from the group consisting of phosphated nonionic emulsifiers and phosphated nonionic emulsifiers blended with another emulsifier selected from the group consisting of aliphatic and aromatic nonionic emulsifiers, said emulsifying agent having an acid number of about 30 to about 130 and a phosphorus content of about 2 percent to about 5 percent.

9. The flame retardant finish of claim 3 which also contains from about 0.2 percent to about 0.8 percent of wetting agent.

10. The flame retardant finish of claim 3 comprising:

(a) from about 22 percent to about 26 percent of said flame retardant compound;

(b) from about 2 percent to about 6 percent of said emulsifying agent;

(c) about 33.8 percent of said tetrakis(hydroxymethyl)phosphonium salt;

(d) about 12.4 percent of said water soluble organic nitrogen containing compound; and (e) about 25.8 percent of said water.

11. The flame retardant finish of claim 10 wherein said flame retardant compound is tris(2,3-dibromopropyl)phosphate and wherein said emulsifying agent is selected from the group consisting of phosphated nonionic emulsifiers and phosphated nonionic emulsifiers blended with another emulsifier selected from the group consisting of aliphatic and aromatic nonionic emulsifiers, said emulsifying agent having an acid number of about 30 to about 130 and a phosphorus content of about 2 percent to about 5 percent.

12. The flame retardant finish of claim 10 wherein said water soluble organic nitrogen containing compound is urea.

13. The flame retardant finish of claim 10 wherein said tetrakis(hydroxymethyl)phosphonium salt is selected from the group consisting of tetrakis(hydroxymethyl)phosphonium oxalate and tetrakis(hydroxymethyl)phosphonium phosphate acetate.

14. The flame retardant finish of claim 13 wherein said flame retardant compound is tris(2,3-dibromopropyl)phosphate, wherein said water soluble organic nitrogen containing compound is urea, and wherein said emulsifying agent is selected from the group consisting of phosphated nonionic emulsifiers and phosphated nonionic emulsifiers blended with another emulsifier selected from the group consisting of aliphatic and aromatic nonionic emulsifiers, said emulsifying agent having an acid number of about 30 to about 130 and a phosphorus content of about 2 percent to about 5 percent.

15. The flame retardant finish of claim 14 wherein said tetrakis(hydroxymethyl)phosphonium salt is tetrakis(hydroxymethyl)phosphonium oxalate.

16. The flame retardant finish of claim 14 wherein said tetrakis(hydroxymethyl)phosphonium salt is tetrakis(hydroxymethyl)phosphonium phosphate acetate.

17. The flame retardant finish of claim 10 which also contains about 0.6 percent of wetting agent.

18. The flame retardant finish of claim 1 wherein said flame retardant compound is selected from $(XH_2C—XCH—H_2C—O)_3—P{=}O$, $(XH—HC(CH_2X)—O)_3—P{=}O$, and mixtures thereof, wherein X is chlorine or bromine; wherein said emulsifying agent is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and the flame retardant compound prepared as in the Solubility Test must remain in one clear homogeneous phase at 22° C. for at least 10 hours; (3) Finish Formulation Test: a flame retardant finish within the scope of this invention is prepared and must remain in one homogeneous phase for a minimum of 2 hours at 20° C.; wherein said water soluble quaternary organohydroxy phosphonium salt is a tetrakis(hydroxymethyl)phosphonium salt selected from the group consisting of tetrakis(hydroxymethyl)phosphonium oxalate, tetrakis(hydroxymethyl)phosphonium phosphate acetate, tetrakis(hydroxymethyl)phosphonium chloride, and bis(tetrakis(hydroxymethyl)phosphonium)sulfate.

19. The flame retardant finish of claim 18 wherein said flame retardant compound is $(XH_2C—XHC—H_2C—O)_3—P{=}O$ and wherein said emulsifying agent is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and the flame retardant compound prepared as in the Solubility Test must remain in one clear homogeneous phase at 22° C. for at least 20 hours; (3) Finish Formulation Test: a flame retardant finish within the scope of this invention is prepared and must remain in one homogeneous phase for a minimum of four hours at 20° C.

20. The flame retardant finish of claim 19 wherein said flame retardant compound is tris(2,3-dibromopropyl)phosphate and wherein said emulsifying agent is selected from the group consisting of phosphated nonionic emulsifiers and phosphated nonionic emulsifiers blended with another emulsifier selected from the group consisting of aliphatic and aromatic nonionic emulsifiers, said emulsifying agent having an acid number of about 30 to about 130 and a phosphorus content of about 2 percent to about 5 percent.

21. The flame retardant finish of claim 19 wherein said water soluble organic nitrogen containing compound is urea.

22. The flame retardant finish of claim 19 wherein said tetrakis(hydroxymethyl)phosphonium salt is selected from the group consisting of tetrakis(hydroxymethyl)phosphonium oxalate and tetrakis(hydroxymethyl)phosphonium phosphate acetate.

23. The flame retardant finish of claim 22 wherein said flame retardant compound is tris(2,3-dibromopropyl)phosphate, wherein said water soluble organic nitrogen containing compound is urea, wherein said tetrakis(hydroxymethyl)phosphonium salt is tetrakis(hydroxymethyl)phosphonium phosphate acetate, and wherein said emulsifying agent is selected from the group consisting of phosphated nonionic emulsifiers and phosphated nonionic emulsifiers blended with another emulsifier selected from the group consisting of aliphatic and aromatic nonionic emulsifiers, said emulsifying agent having an acid number of about 30 to 130 and a phosphorus content of about 2 percent to about 5 percent.

24. The flame retardant finish according to claim 18 which also contains from about 0.1 percent to about 1.0 percent of a wetting agent.

25. The flame retardant finish according to claim 1 which also contains from about 0.1 percent to about 1.0 percent of a wetting agent.

26. A process for treating textile materials to render them flame retardant which comprises applying to said textile the flame retardant finish of claim 1.

27. A textile material obtained by the process of claim 26.

28. An emulsion concentrate for preparing the textile finish of claim 1 comprising:

(a) from about 70 percent to about 97 percent of a flame retardant compound of the formula $(RO)_3P{=}O$ wherein R is independently selected from halogenated aliphatic groups containing from 2 to about 6 carbon atoms and from 1 to about 3 halogen substituents per group and mixtures thereof; and (b) from about 3 percent to about 30 percent of an emulsifying agent which is capable of passing the following three tests: (1) Solubility (Compatibility) Test: said emulsifying agent (20 parts by weight) must be soluble in 80 parts by weight of the flame retardant compound at no more than 80° C; (2) Shelf Life Test: a blend of said emulsifying agent and said flame retardant compound prepared as in the Solubility Test must remain in one clear homogeneous phase at 22° C. for at least 1 hour; (3) Finish Formulation Test: a flame retardant finish within the scope of this invention is prepared and must remain in one homogeneous phase for a minimum of 1 hour at 20° C.

29. The emulsion concentrate of claim 28 comprising:

(a) from about 75 percent to about 95 percent of said flame retardant compound; and (b) from about 5 percent to about 25 percent of said emulsifying agent which is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and said flame retardant compound prepared as in the Solubility Test must remain in one clear homogeneous phase at 22° C. for at least 10 hours; (3) Finish Formulation Test: a flame retardant finish within the scope of this invention is prepared and must remain in one homogeneous phase for a minimum of 2 hours at 20° C.

30. The emulsion concentrate of claim 29 comprising:

(a) from about 80 percent to about 90 percent of said flame retardant compound; and (b) from about 10 percent to about 20 percent of said emulsifying agent which is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and said flame retardant compound prepared as in the Solubility Test must remain in one clear homogeneous phase at 22° C. for at least 20 hours; (3) Finish Formulation Test: a flame retardant finish within the scope of this invention is prepared and must remain in one homogeneous phase for a minimum of four hours at 20° C.

31. The emulsion concentrate of claim 28 wherein said flame retardant is selected from $(XH_2C—X-CH—H_2C—O)_3—P{=}O$, $(XH_2C—HC(CH_2X)—O)_3—P{=}O$, and mixtures thereof wherein X is chlorine or bromine and wherein said emulsifying agent is selected from the group consisting of phosphated nonionic emulsifiers and phosphated nonionic emulsifiers blended with another emulsifier selected from the group consisting of aliphatic and aromatic nonionic emulsifiers, said emulsifying agent having an acid number of about 30 to about 130 and a phosphorus content of about 2 percent to about 5 percent.

32. The emulsion concentrate of claim 31 wherein said flame retardant compound is $(XH_2C—XCH—H_2C—O)_3—P{=}O$ and wherein said emulsifying agent has an acid number from about 30 to about 130 and a phosphorus content from about 2 to about 5 percent.

33. The emulsion concentrate of claim 32 wherein said flame retardant compound is tris(2,3-dibromopropyl)phosphate and wherein said emulsifying agent has an acid number from about 48 to about 120 and a phosphorus content from about 2.2 percent to about 4.0 percent.

34. The emulsion concentrate of claim 28 wherein said emulsifying agent is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and said flame retardant compound prepared as in the Solubility Test must remain in one clear homogeneous phase at 22° C. for at least 1 hour; (3) Emulsion Stability Test: a blend of said emulsifying agent and said flame retardant compound prepared as in the Solubility Test must remain in a stable aqueous emulsion for at least one hour, said aqueous emulsion being prepared as follows: (a) heat 500 gms of deionized water to 93° to 100° C.; (b) while stirring, slowly add 250 gms of said blend to said heated deionized water and continue stirring for 25 minutes after final blend addition, maintaining the emulsion temperature at 96° C. for 15 minutes; and (c) while stirring, add sufficient cold water to bring the total weight of the emulsion up to 1000 gms.

35. An emulsion for preparing the textile finish of claim 1 comprising:

(a) from about 8 percent to about 50 percent of a flame retardant compound of the formula $(RO)_3P{=}O$ wherein each R is independently selected from halongenated aliphatic groups containing from 2 to about 6 atoms and from 1 to about 3 halogen substituents per group and mixtures thereof;

(b) from about 0.2 percent to about 22 percent of an emulsifying agent which is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and said flame retardant compound prepared as in the Solubility Test must remain in one clear homogeneous phase at 22° C. for at least 1 hour; (3) Finish Formulation Test: a flame retardant finish within the scope of this invention is prepared and must remain in one homogeneous phase for a minimum of 1 hour at 20° C.; and (c) from about 28 percent to about 92 percent of water.

36. The emulsion of claim 35 comprising:

(a) from about 15 percent to about 40 percent of said flame retardant compound;

(b) from about 0.8 percent to about 14 percent of said emulsifying agent which is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and said flame retardant compound prepared as in the Solubility Test must remain in one clear homogeneous phase at 22° C. for at least 10 hours; (3) Finish Formulation Test: a flame retardant finish within the scope of this invention is prepared and must remain in one homogeneous phase for a minimum of 2 hours at 20° C.; and (c) from about 45 percent to about 85 percent of said water.

37. The emulsion of claim 36 comprising:

(a) from about 20 percent to about 30 percent of said flame retardant compound;

(b) from about 2 percent to about 8 percent of said emulsifying agent which is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and said flame retardant compound prepared as in the Solubility Test must remain in one clear homogeneous phase at 22° C. for at least 20 hours; (3) Finish Formulation Test: a flame retardant finish within the scope of this invention is prepared and must remain in one homogeneous phase for a minimum of 4 hours at 20° C.;

(c) from about 52 percent to about 78 percent of said water.

38. The emulsion of claim 35 wherein said flame retardant compound is selected from $(XH_2C—XHC—H_2C—O)_3—P{=}O$, $(XH_2C—HC(CH_2X)—O)_3—P{=}O$, and mixtures thereof wherein X is chlorine or bromine and wherein said emulsifying agent is selected from the group consisting of phosphated nonionic emulsifiers and phosphated nonionic emulsifiers blended with another emulsifier selected from the group consisting of aliphatic and aromatic nonionic emulsifiers, said emulsifyng agent having an acid number of about 30 to about 130 and a phosphorus content of about 2 percent to about 5 percent.

39. The emulsion of claim 38 wherein said flame retardant compound is $(XH_2C—XHC—H_2C—O)_3—P-$ =O and wherein said emulsifying agent has an acid number from about 30 to about 130 and a phosphorus content from about 2 to about 5 percent.

40. The emulsion of claim 39 wherein said flame retardant compound is tris(2,3-dibromopropyl)phosphate and wherein said emulsifying agent has an acid number from about 48 to about 120 and a phosphorus content from about 2.2 percent to about 4.0 percent.

41. An intermediate flame retardant composition comprising:

(a) from about 20 percent to about 38 percent of a flame retardant compound of the formula $(RO)_3$—P=O wherein each R is independently selected from halogenated aliphatic groups containing from 2 to about 6 carbon atoms and from 1 to about 3 halogen substituents per group and mixtures thereof;

(b) from about 0.5 percent to about 12 percent of an emulsifying agent which is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and said flame retardant compound prepared as in the Solubility Test must remain in one clear homogeneous phase at 22° C. for at least 1 hour; (3) Finish Formulation Test: a flame retardant finish within the scope of this invention is prepared and must remain in one homogeneous phase for a minimum of 1 hour at 20° C.;

(c) from about 34 percent to about 47 percent of a water soluble quaternary phosphonium salt selected from the group consisting of tetrakis(hydroxymethyl) phosphonium and tetrakis(methylhydroxymethyl) phosphonium salts; and (d) from about 20 percent to about 33 percent of water.

42. The intermediate flame retardant composition of claim 41 comprising:

(a) from about 22 percent to about 35 percent of said flame retardant compound;

(b) from about 1.5 percent to about 10 percent of said emulsifying agent which is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and said flame retardant compound prepared as in the Solubility Test must remain in one clear homobeneous phase at 22° C. for at least 10 hours; (3) Finish Formulation Test: a flame retardant finish within the scope of this invention is prepared and must remain in one homogeneous phase for a minimum of 2 hours at 20° C.;

(c) from about 36 percent to about 45 percent of said water soluble quaternary phosphonium salt; and (d) from about 21 percent to about 31 percent of water.

43. The intermediate flame retardant finish of claim 42 comprising:

(a) from about 25 percent to about 32 percent of said flame retardant compound;

(b) from about 3 percent to about 7 percent of said emulsifying agent which is capable of passing the following three tests: (1) Solubility (Compatability) Test: said emulsifying agent (20 parts by weight) must be soluble in 80 parts by weight of the flame retardant compound at no more than 80° C.; (2) Shelf Life Test: a blend of said emulsifying agent and said flame retardant compound prepared as in the Solubility Test must remain in one clear homogeneous phase at 22° C. for at least 20 hours; (3) Finish Formulation Test: a flame retardant finish within the scope of this invention is prepared and must remain in one homogeneous phase for a minimum of four hours at 20° C.;

(c) from about 38 percent to about 43 percent of said water soluble quaternary phosphonium salt; and (d) from about 22 percent to about 30 percent of water.

44. The intermediate flame retardant composition of claim 41 wherein said flame retardant compound is selected from $(XH_2C—XHC—H_2C—O)_3—P=O$, $(XH_2C—HC(CH_2X)—O)_3—P=O$, and mixtures thereof wherein X is chlorine or bromine; wherein said emulsifying agent is selected from the group consisting of phosphated nonionic emulsifiers and phosphated nonionic emulsifiers blended with another emulsifier selected from the group consisting of aliphatic and aromatic nonionic emulsifiers, said emulsifying agent having an acid number of about 30 to about 130 and a phosphorus content of about 2 percent to about 5 percent; and wherein said water soluble quaternary phosphonium salt is a tetrakis(hydroxymethyl)phosphonium salt selected from the group consisting of tetrakis(hydroxymethyl)phosphonium oxalate, tetrakis(hydroxymethyl)phosphonium acetate, tetrakis(hydroxymethyl)phosphonium chloride, and bis(tetrakis(hydroxymethyl)phosphonium)sulfate.

45. The intermediate flame retardant composition of claim 44 wherein said flame retardant compound is $(XH_2C—XHC—H_2C—O)_3—P=O$ and wherein said emulsifying agent has an acid number from about 30 to about 130 and a phosphorus content from about 2 to about 5 percent.

46. The intermediate flame retardant composition of claim 45 wherein said flame retardant compound is tris(2,3-dibromopropyl)phosphate and wherein said emulsifying agent has an acid number from about 48 to about 120 and a phosphorus content from about 2.2 percent to about 4.0 percent.

47. The flame retardant finish of claim 46 wherein said tetrakis(hydroxymethyl)phosphonium salt is selected from the gorup consisting of tetrakis(hydroxymethyl)phosphonium oxalate and tetrakis(hydroxymethyl)phosphonium phosphate acetate.

48. The flame retardant finish of claim 41 which also contains about 0.2 to about 0.8 percent of wetting agent.

* * * * *